US006319103B1

(12) United States Patent
Kim

(10) Patent No.: US 6,319,103 B1
(45) Date of Patent: Nov. 20, 2001

(54) CHEMICAL MECHANICAL POLISHING APPARATUS

(75) Inventor: Chang Gyu Kim, Kyoungki-do (KR)

(73) Assignee: Dongbu Electronics Co., Ltd., Seoul (KR)

( * ) Notice: Subject to any disclaimer, the term of this patent is extended or adjusted under 35 U.S.C. 154(b) by 0 days.

(21) Appl. No.: 09/513,382

(22) Filed: Feb. 25, 2000

(51) Int. Cl.[7] ..... B24B 7/22
(52) U.S. Cl. ..... 451/173; 451/168
(58) Field of Search ..... 451/41, 168, 173, 451/307; 125/16.02, 21

(56) References Cited

U.S. PATENT DOCUMENTS 1,912,016 * 5/1933 Sittner ..... 451/168
3,674,004 * 7/1972 Grandia et al. ..... 125/16.01
3,824,982 * 7/1974 Bowman ..... 125/16.01
5,564,409 * 10/1996 Bonzo et al. ..... 125/16.02

FOREIGN PATENT DOCUMENTS

2906238 * 8/1980 (DE) ..... 451/41
717874 * 11/1954 (GB) ..... 125/16.02

* cited by examiner

*Primary Examiner*—Robert A. Rose
(74) *Attorney, Agent, or Firm*—Andrus, Sceales, Starke & Sawall, LLP

(57) ABSTRACT

Disclosed is a chemical mechanical polishing("CMP") apparatus. The present invention provides a CMP apparatus having a rotatable wafer holder in which a wafer is fixed. At a bottom of the wafer holder, a pair of driving roller is arranged and the respective rollers are rotated by motors. A polishing wire is winded between the respective driving rollers, the polishing wire is stuck to the wafer fixed at the wafer holder and the polishing wire moves in a linear reciprocal movement. Meanwhile, guide-rollers for providing tension with the polishing wire are arranged at outer portions of the respective driving rollers thereby winding both ends of the polishing wire at the respective guide-rollers. Further, a height adjusting member for is arranged at bottom portions of the polishing wire thereby adjusting the height of the polishing wire owing to a rise of the height adjusting member.

8 Claims, 3 Drawing Sheets

CHEMICAL MECHANICAL POLISHING APPARATUS

BACKGROUND OF THE INVENTION

1. Field of the Invention

The present invention relates to a chemical mechanical polishing(hereinafter "CMP") apparatus, and more particularly to a CMP apparatus in which a chemical mechanical polishing is performed at a wafer surface.

2. Description of the Related Art

Due to the recent developments in manufacture of semiconductors, semiconductor devices have been highly integrated. To achieve high integration in the semiconductor device, it is required to obtain photolithography margins or a planarization process at a bottom layer so as to minimize its wiring length. According to these requirements, the CMP method has been introduced as a known technology to planarize a bottom layer. Among the semiconductor manufacturing procedures, the CMP method is utilized at a step of planarizing the bottom layer formed on a wafer surface. In the CMP method, the wafer surface is chemical-reacted with slurry containing microscopic particles and the chemically reacted wafer surface is mechanically polished with a polishing pad.

The conventional CMP apparatus using slurry and polishing pad consist of a polishing pad rotating operator, a wafer holder that a wafer is fixed in, and a slurry supplier which supplies slurry on a wafer surface.

The conventional CMP apparatus as constituted above, however, incurs a disadvantage that pressure from the polishing pad to the wafer is locally different, and then the polishing thickness is not uniform.

Specifically, there is a strong possibility of transformation in the polishing pad since the polishing pad rotates and is contacted closely to the wafer surface. When the polishing pad is transformed, a dishing is occurred at the rotating polishing pad. Therefore, when the dishing is occurred at the polishing pad, should the polishing pad should be substituted at once. Due to the substitution, the realization of CMP process may be deteriorated during a polishing process using the new polishing pad.

SUMMARY OF THE INVENTION

It is one object of the present invention to provide a CMP apparatus capable of applying a constant pressure to a wafer thereby improving uniformity in the polishing thickness.

It is another object of the present invention to realize the CMP process by extending lifetime of apparatus.

To accomplish, the present invention provides a CMP apparatus having a rotatable wafer holder in which a wafer is fixed. At a bottom of the wafer holder, a pair of driving roller is arranged and the respective rollers are rotated by motors. A polishing wire is winded between the respective driving rollers, the polishing wire is stuck to the wafer fixed at the wafer holder and the polishing wire moves in a linear reciprocal movement. Meanwhile, guide-rollers for providing tension with the polishing wire are arranged at outer portions of the respective driving rollers thereby winding both ends of the polishing wire at the respective guide-rollers. Further, a height adjusting member is arranged at bottom portions of the polishing wire thereby adjusting the height of the polishing wire owing to a rise of the height adjusting member.

DETAILED DESCRIPTION OF THE PREFERRED EMBODIMENTS

Figure 1:
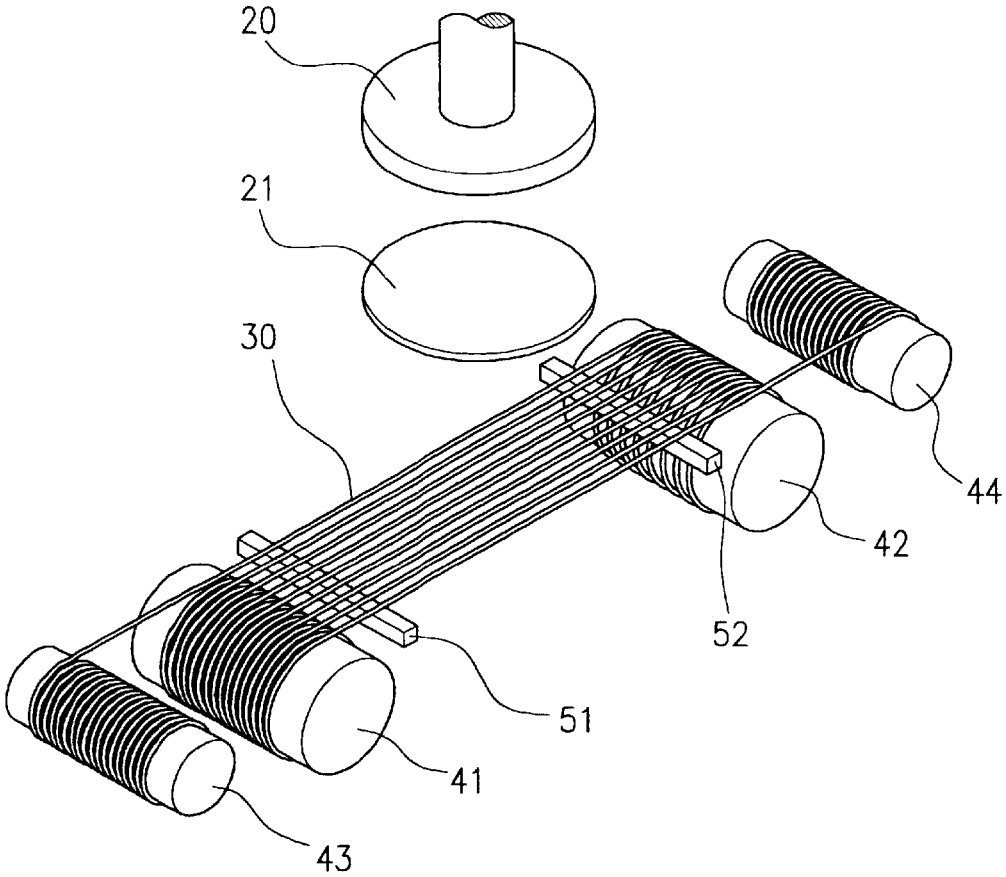
FIGS. 1 and 2 are a perspective view and a front-sectional view of a CMP apparatus according to a first embodiment of the present invention.
Figure 2:
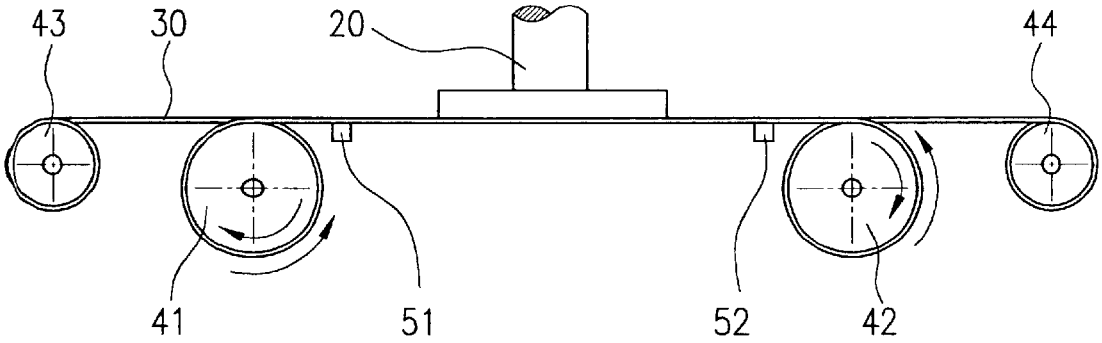

As shown in FIGS. 1 and 2, a wafer 21 is fixed at a bottom of a wafer holder 20. Although not shown in the drawing, the wafer holder is rotated by a motor-like driving means. A pair of driving rollers 41,42 are horizontally arranged at a bottom of the wafer holder 20. These driving rollers 41,42 are also rotated by motors, not shown. Further, a pair of guide-rollers 43,44 are arranged at both outer sides of the respective driving rollers 41,42.

A polishing wire 30 is winded at each driving roller 41, 42. The polishing wire 30 is contacted and rubbed with the rotating wafer 21. Accordingly, a plurality of polishing wires 30 are arranged with identical distance on the bottom of the wafer holder 20, and are moved in a linear reciprocal movement by the driving rollers 41, 42 rotating in the same direction. The polishing wire 30 may have its sectional view as a circular section. However, the section may have with saw teeth in its circumference for the sake of polishing efficiency as well. Materials for the polishing wire 30 may be selected from a group consisting of metal, nylon, teflon, polyurethane and a structure of a metal coated with polyurethane. In the meantime, to apply tension to the polishing wire 30, both ends of the polishing wire 30 are winded at the guide-rollers 43, 44.

Furthermore, in addition to applying tension at the polishing wire 30, a pair of height adjusting members 51,52 are arranged at the bottom of the polishing wire 30 to adjust height thereof. The height adjusting members 51,52 are preferably made of materials of elasticity. Meanwhile, the distance between the polishing wire 30 is easy to adjust by forming grooves, not shown, at the circumference of the respective driving rollers 41,42.

A polishing operation performed at the wafer by the CMP apparatus as constituted above and according to the first embodiment of the present invention will be made hereinafter.

The wafer 21 is fixed at a bottom of the wafer holder 20. Hereunder, the wafer holder 20 is rotated by the motor. Meanwhile, each driving roller 41,42 is periodically rotated or backlashed in the same direction by the motor. Accordingly, the polishing wires 30 move in a linear reciprocal movement. Since the linearly rotating polishing wire 30 is contacted and rubbed with the wafer 21, the wafer 21 is polished. Herein, the wafer 21 is rotated by the wafer holder 20 and is simultaneously contacted and rubbed thereby polishing the wafer 21 entirely uniform not incurring certain lines due to the polishing wire 30 along a specific direction.

The CMP apparatus of the present invention also utilizes a conventional slurry supplier (not shown) for supplying slurry to the surface of wafer 21. Accordingly, a slurry of conventional composition is supplied over the surface of the wafer 21.

Figure 3:
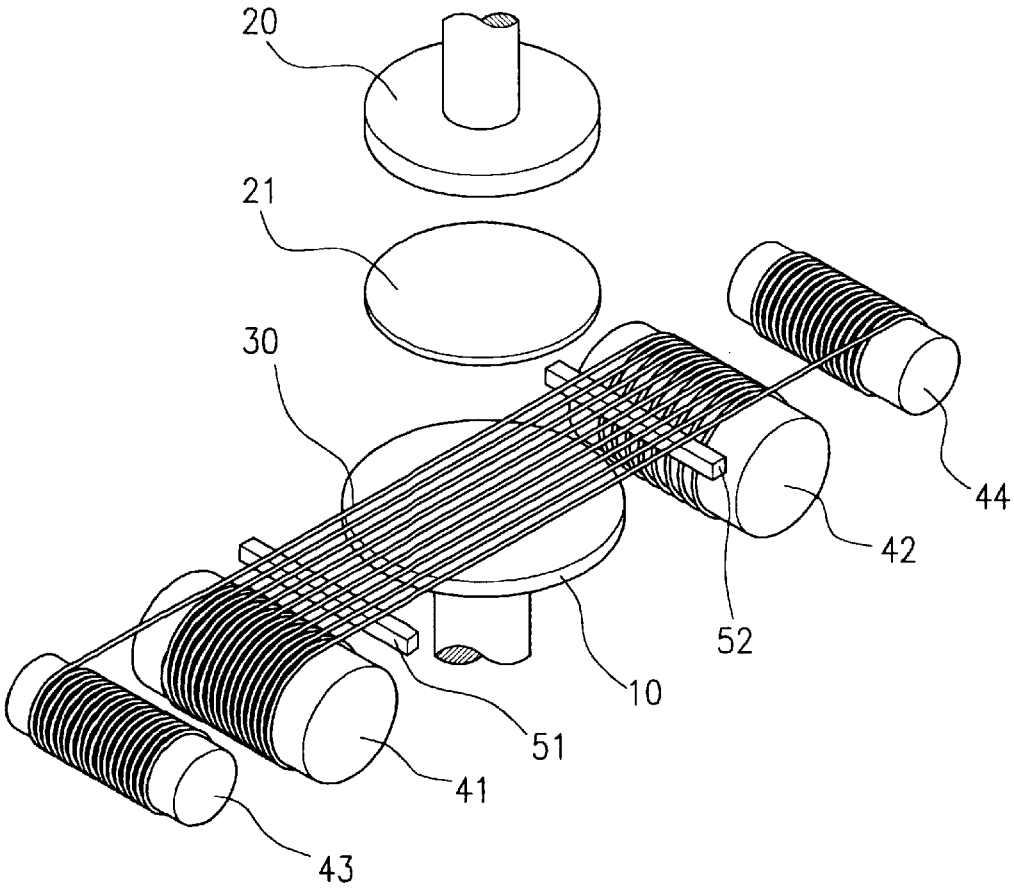
FIGS. 3 to 5 are a perspective view, a front-sectional view and a plane view of a CMP apparatus according to a second embodiment of the present invention.
Figure 4:
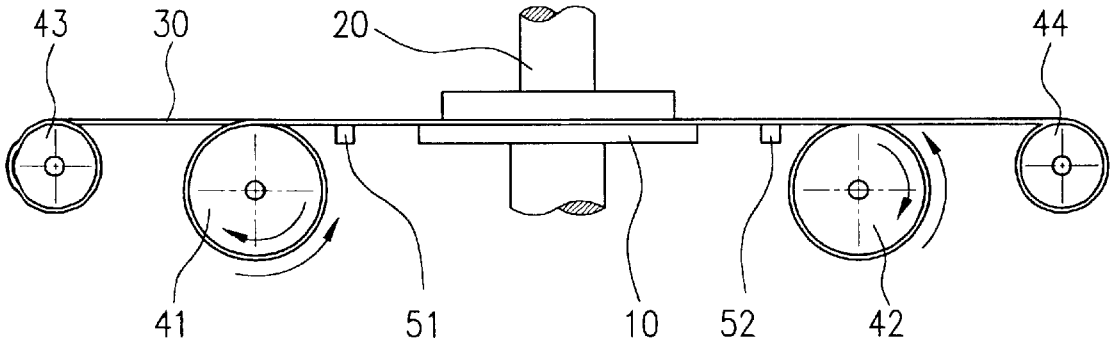
Figure 5:
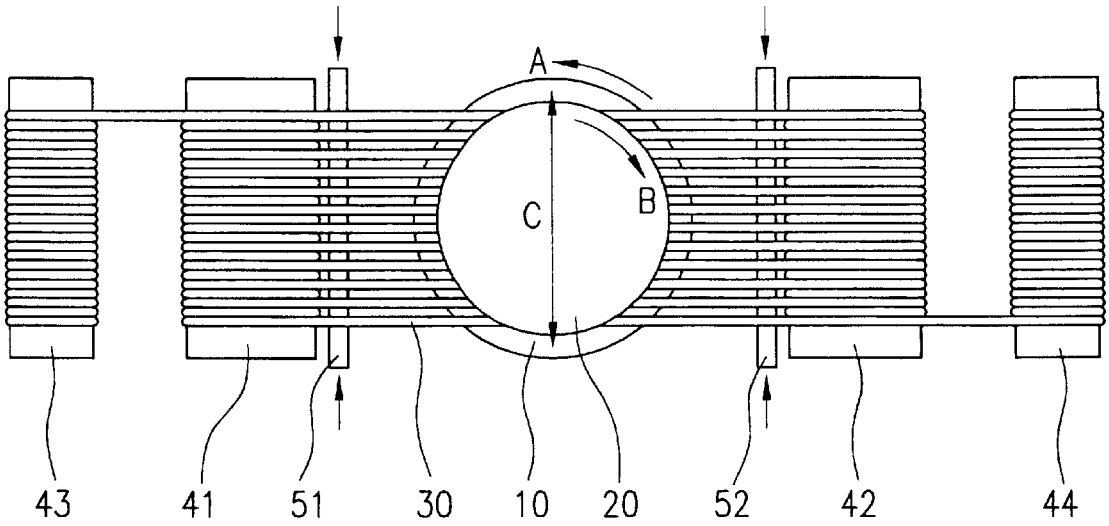

As shown in FIGS. 3 to 5, a CMP apparatus according to the second embodiment includes a rotating plate 10 in addition to the CMP apparatus of the first embodiment. The rotating plate 10 is arranged at a bottom of a polishing wire, i.e. between the respective driving rollers 41,42, and the rotating plate 10 props up the polishing wire 30. As shown in FIG. 5, when the rotating plate 10 moves along the A direction, the wafer holder 20 rotates along the B direction and simultaneously moves along the C direction in a reciprocal movement.

Therefore, during polishing motion, the polishing wire 30 is prevented from being pressed by the wafer 21. Thus, polishing efficiency is more enhanced.

Figure 6:
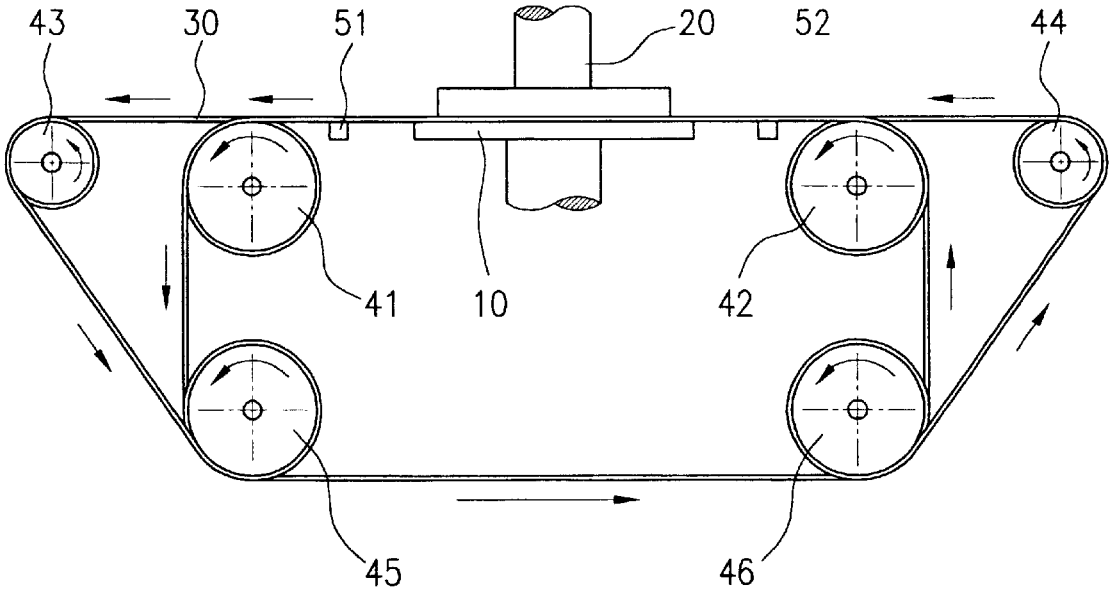
FIG. 6 is a front sectional view of a CMP apparatus according to a third embodiment of the present invention.

As shown in FIG. 6, in a CMP apparatus according to the third embodiment, a polishing wire 30 moves likewise a caterpillar. For the purpose of the motion, driven rollers 45,46 are added to the CMP apparatus. The respective driven rollers 45,46 are arranged perpendicularly beneath the respective driving rollers 41,42.

Meanwhile, the polishing wire 30 are winded along the driving and the driven rollers 41,42,45,46 arranged in a rectangular form, and winded at a left guide-roller 42, then passed under the respective driven rollers 45,46, and finally winded at a right guide-roller 44. The polishing wire 30 rotates likewise a caterpillar.

Although a rotating plate 10 is illustrated in FIG. 6, the rotating plate 10 can be omitted as in the first embodiment.

According to the present invention as described above, a polishing wire having firmness and strong hardness is used for polishing the wafer thereby improving uniformity of wafer polishing and planarization quality. Further, the polishing wire can be used through long time thereby obtaining realization in a CMP process.

What is claimed is:

1. A chemical mechanical polishing apparatus, comprising:

a rotatable wafer holder, having an axis of rotation;

a wafer fixed on said wafer holder, said wafer including a surface to be polished; means for feeding said rotatable wafer holder along said axis a slurry supplier for supplying slurry to said surface of said wafer;

a pair of driving rollers horizontally arranged beneath the wafer holder, said driving rollers rotating in a reciprocal movement;

a polishing wire wound on the driving rollers and moving in a linear reciprocal movement as the driving rollers are rotated in their respective reciprocal movement thereby contacting and rubbing on the surface to be polished of said wafer fixed on said wafer holder;

a pair of guide-rollers horizontally arranged outside of the respective driving rollers wherein opposite ends of said polishing wire are wound thereon to thereby apply tension to said polishing wire;

wherein the surface of the wafer is polished by the slurry and the linear reciprocal movement of the polishing wire.

2. The chemical mechanical polishing apparatus of claim 1 further including a rotating plate disposed beneath said polishing wire so as to support the polishing wire.

3. The chemical mechanical polishing apparatus of claim 1 further including a height adjusting member for adjusting the height of the polishing wire disposed beneath said polishing wire.

4. The chemical mechanical polishing apparatus of claim 1 wherein the polishing wire is composed of a material selected from the group consisting of a metal, nylon, teflon, polyurethane and a metal coated with polyurethane.

5. A chemical mechanical polishing apparatus, comprising:

a rotatable wafer holder; having an axis of rotation a wafer fixed on said wafer holder, said wafer including a surface to be polished; means for feeding said rotatable wafer holder along said axis a slurry supplier for supplying slurry to said surface of said wafer;

a pair of driving rollers horizontally arranged beneath the wafer holder, said driving rollers rotating in a reciprocal movement;

a polishing wire wound on the driving rollers and moving in a linear reciprocal movement as the driving rollers are rotated in their respective reciprocal movement thereby contacting and rubbing on the surface to be polished of said wafer fixed on said wafer holder;

a pair of guide-rollers horizontally arranged outside of the respective driving rollers wherein opposite ends of said polishing wire are wound thereon to thereby apply tension to said polishing wire;

a pair of driven rollers arranged beneath the driving rollers, said polishing wire being wound thereon and thereby guided to the driving rollers;

wherein the surface of the wafer is polished by the slurry and the linear reciprocal movement of the polishing wire.

6. The chemical mechanical polishing apparatus of claim 5 further including a rotating plate disposed beneath said polishing wire so as to support the polishing wire.

7. The chemical mechanical polishing apparatus of claim 5 further including a height adjusting member for adjusting the height of the polishing wire disposed beneath said polishing wire.

8. The chemical mechanical polishing apparatus of claim 5 wherein the polishing wire is composed of a material selected from the group consisting of a metal, nylon, teflon, polyurethane and a metal coated with polyurethane.

* * * * *